US005603497A

United States Patent [19]

Louez

[11] Patent Number: 5,603,497

[45] Date of Patent: Feb. 18, 1997

[54] THREE PIECE BALL TEMPLATE

[76] Inventor: Nigel R. Louez, Suite 1, 192B Kurraba Road, Neutral Bay, Australia

[21] Appl. No.: 244,654

[22] PCT Filed: Oct. 12, 1993

[86] PCT No.: PCT/AU93/00523

§ 371 Date: Aug. 26, 1994

§ 102(e) Date: Aug. 26, 1994

[87] PCT Pub. No.: WO94/08665

PCT Pub. Date: Apr. 28, 1994

[30] Foreign Application Priority Data

Oct. 12, 1992 [AU] Australia ..... PL5200

[51] Int. Cl.[6] ..... A63B 41/08

[52] U.S. Cl. ..... 473/609; 473/606; 473/607

[58] Field of Search ..... 273/58 R, 58 A, 273/58 B, 58 BA, 60 R, 60 A, 61 R, 65 E, 65 EE, 65 B, 65 R, 65 A, 65 EC, 65 EG, 58 D, 58 K

[56] References Cited

U.S. PATENT DOCUMENTS

| | | | |
|---|---|---|---|
| 617,796 | 1/1899 | Wright | 273/58 B |
| 1,634,146 | 6/1987 | Henry | 273/58 BA |
| 2,021,042 | 11/1935 | Bayon | 273/61 R |
| 4,718,670 | 1/1988 | Gray | 273/61 R |

FOREIGN PATENT DOCUMENTS

| | | | |
|---|---|---|---|
| 56800 | 10/1990 | Australia . | |
| 0387370 | 9/1990 | European Pat. Off. . | |
| 1-090376 | 8/1976 | Japan . | |
| 125575 | 7/1984 | Japan | 273/65 ED |
| 317138 | 8/1979 | United Kingdom | 273/58 A |
| 2162072 | 1/1986 | United Kingdom . | |

*Primary Examiner*—Steven Wong
*Attorney, Agent, or Firm*—Ladas & Parry

[57] ABSTRACT

A ball structure (1) is disclosed which comprises three panels (2, 3, 4) of identical shape which can be joined to form a spherical ball. The panels (2, 3, 4) can be cut from a template and their shape is adapted to minimize wastage of a substrate material cut according to a pattern provided by the template.

5 Claims, 4 Drawing Sheets

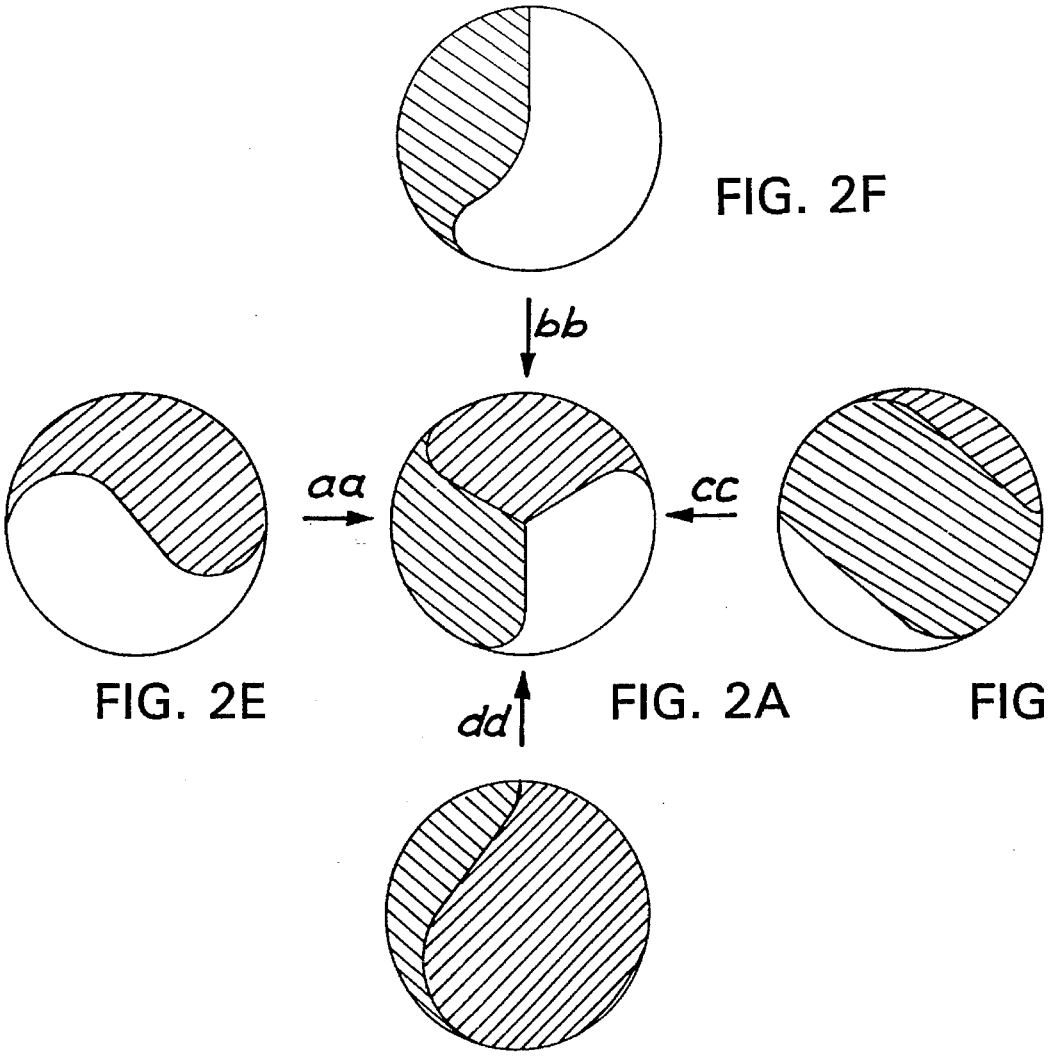
FIG. 2F
FIG. 2E
FIG. 2A
FIG. 2C
FIG. 2D
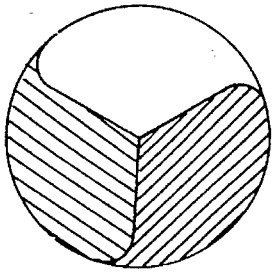
FIG. 2B

THREE PIECE BALL TEMPLATE

FIELD OF THE INVENTION

The present invention relates to balls manufactured of multiple segments and, in particular, discloses a ball structure that can be economically manufactured from three ball segments.

BACKGROUND ART

It is known for example to manufacture a tennis ball from two panels of felt cut in complementary dumbbell-like shapes. When bent and interlocked, the two dumbbell shapes form a substantial sphere and when affixed along their peripheral edges complete the structure of the ball. However, in such a construction there is a substantial waste of the felt when the dumbbell panels are cut from a sheet of substrate material. This waste represents an additional cost in the manufacture of such balls.

It is also known to manufacture a ball from three panels each having a leaf-like, oval, shape. Such a manufacture is also subject to the same or similar waste as the tennis ball.

SUMMARY OF THE INVENTION

It is an object of the present invention to substantially overcome, or ameliorate, the abovementioned problems through provision of a ball and a method of manufacture thereof which reduces the waste in a substrate material.

In accordance with one aspect of the present invention there is disclosed a ball comprising three panels, each of said panels having at least two parallel edges with said panels being adapted to be joined to form a spherical surface.

In accordance with another aspect of the present invention there is disclosed a template for the manufacture of a ball from a material substrate, said template comprising an array of identical panel sections each substantially rectangular in shape and comprising two substantially parallel elongate sides, two diagonally opposed curved corner sections, and two diagonally opposed obtuse corner sections, wherein said template provides a cutting grid upon said substrate from which said panels can be cut, and from which said ball can be formed by joining any three panels.

BRIEF DESCRIPTION OF THE DRAWINGS

A number of preferred embodiment of the present invention will now be described with reference to the drawings in which:

FIGS. 2(A)–2(F) shows various views of a ball constructed using the panels of FIG. 1;

BEST AND OTHER MODES FOR CARRYING OUT THE INVENTION

Figure 1:
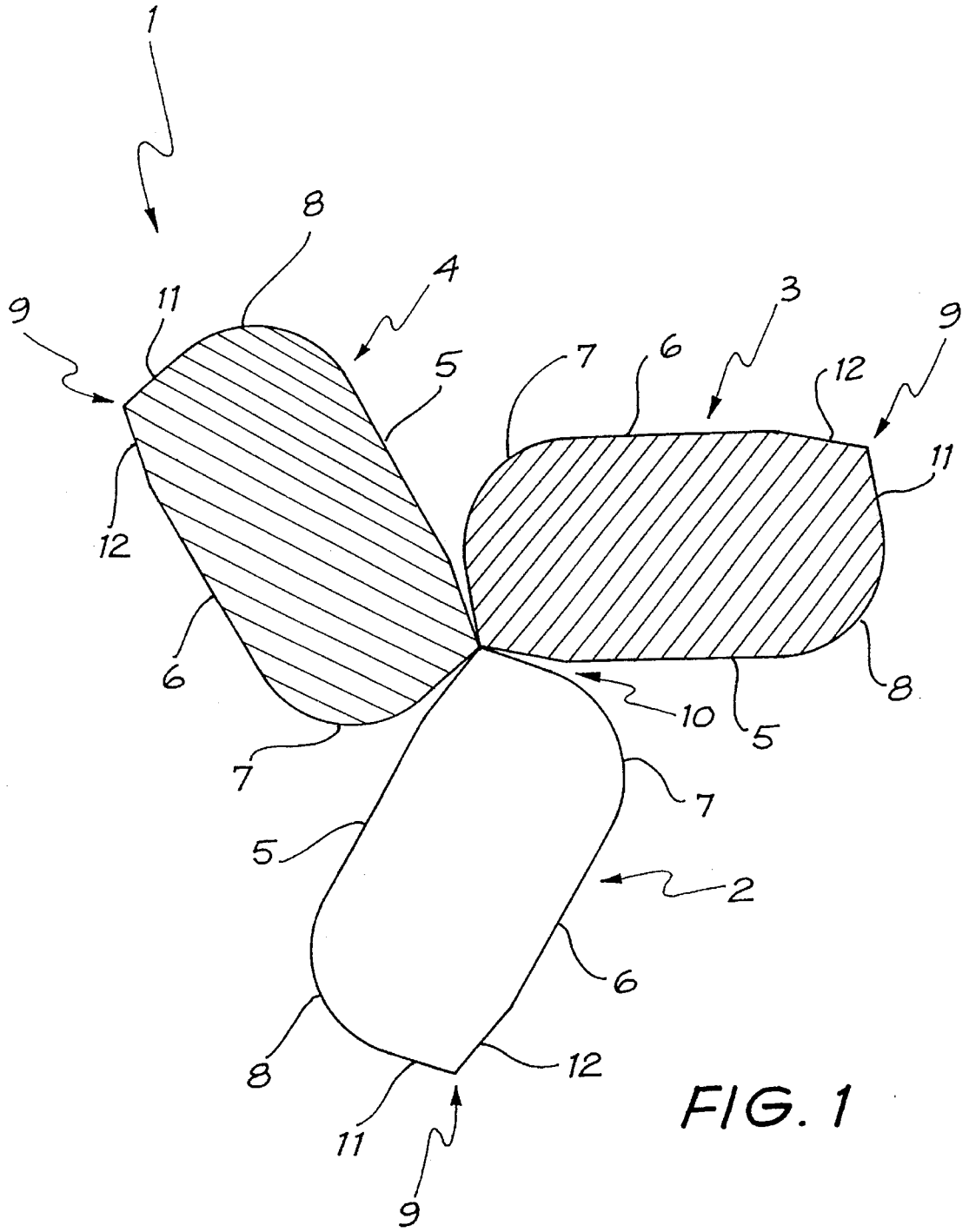
FIG. 1 is a plan view of three panels configured immediately prior to bending to form a spherical ball.

With reference to FIG. 1, a ball structure 1 is shown which is formed from three panels 2, 3 and 4 which can be cut from a template. Panels are generally manufactured of a material or materials useful for the economical manufacture of balls, such as tennis ball felt, rubber and rubber composite materials, to name but a few. The panels 2, 3 and 4 can be colored identically or each panel may be colored differently as desired by the ball manufacturer. It should be noted in this connection that the shading of the panels shown in FIG. 1 and FIGS. 1(A)–2(F) is not meant to indicate any particular color pattern, but to merely illustrate that the panels may be differently colored.

As seen in FIG. 1, each of the panels 2, 3 and 4 is of a substantially rectangular shape having parallel elongate edges 5 and 6, and diagonally opposed curved corner edges 7 and 8. Adjacent each of the curved corners 7 and 8 are diagonally opposed obtuse corners 9 and 10, each having an identifiable point. In each case, the corners 9,10 are formed by the intersection of two edges 11 and 12, the edge 11 extending from either one of the curved comers 7, 8, and the edge 12 extending from either one of the parallel edges 5, 6. The edges 11 and 12 meet to form an obtuse angle at that periphery of the panel 2, 3, 4. The actual angle subtended between the edges 11 and 12 must exceed 90° and is typically between 100° and 140°. The angle in particular dictates how each of panels 2, 3, 4 join to form the poles of ball, with changes in the angle representing a departure from an optimal spherical shape. Generally for a substantial spherical shape, the angle is between 110° and 130°, and most preferably about 112° to 115°.

As illustrated, the three panels 2, 3 and 4 are positioned for forming the ball such that three obtuse corners 10 meet such that the panels 2, 3 and 4 are folded until their edges contact each other whereupon they are welded or otherwise joined to form a preferably spherical ball shape.

With reference to FIGS. 2(A)–2(F), it will be apparent that the intersection of the obtuse corners 9 and 10 represent the two poles of the sphere and that the curved corners and 8 impart a twist to the inclination of each panel 2, 3, 4 about the sphere.

Figure 3:
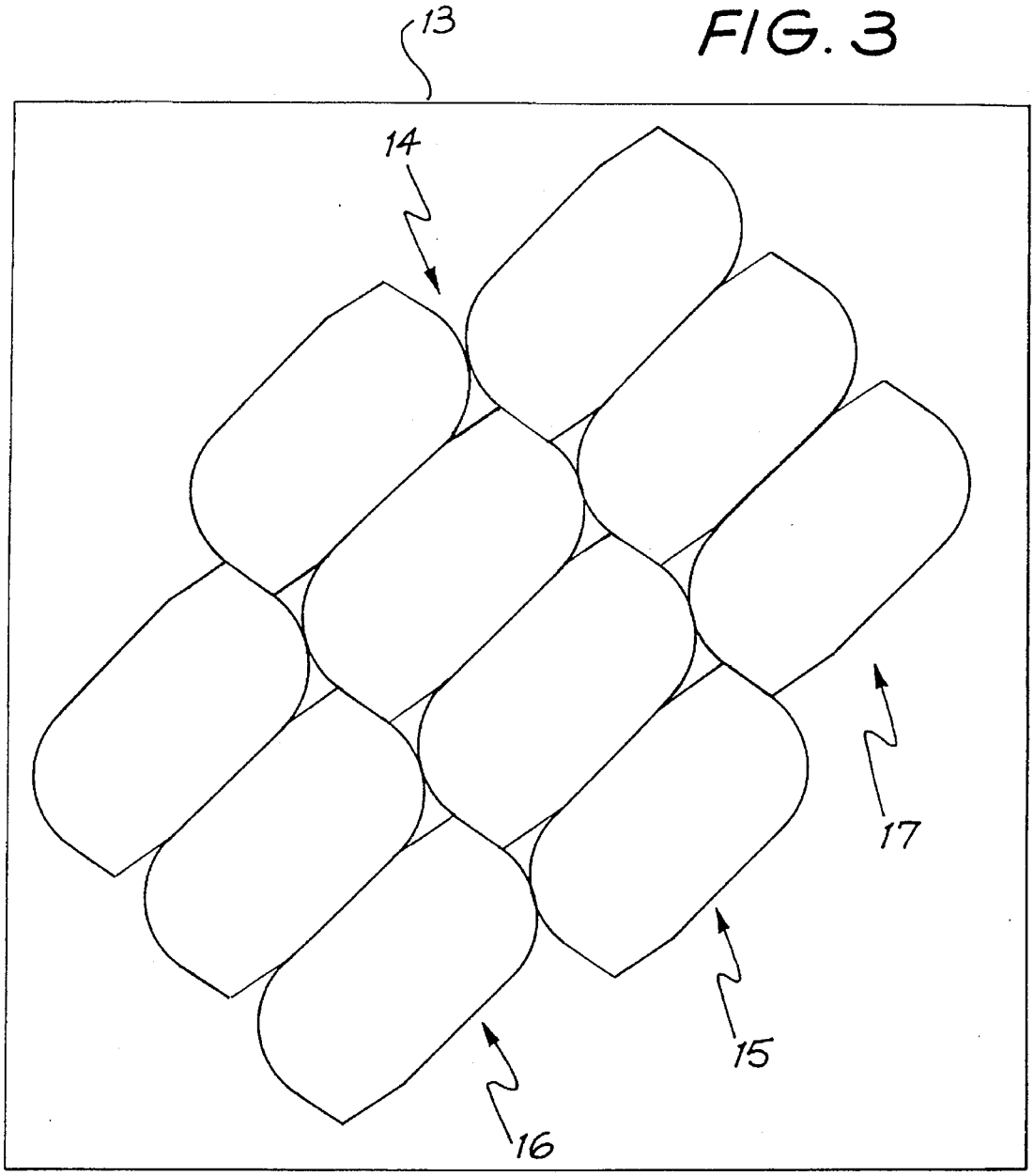
FIG. 3 illustrates a knife grid pattern from which the panels of FIGS. 1 and 2 can be cut to minimize wastage of material.

Referring to FIG. 3, a sheet of material substrate 13 is shown marked with a template pattern 14 which provides the panel shape of the preferred embodiment. With this shape, as shown and described above, the space between adjacent panels in the template 14 is minimized thereby reducing waste of material.

In FIG. 3, the template pattern 14 shows a two-dimensional array of panels configured such that panels in one row 15 are displaced by half a panel width from panels in adjacent rows 16 and 17. Where appropriate, a square grid arrangement may be used where this is no disposition between adjacent rows.

Figure 4:
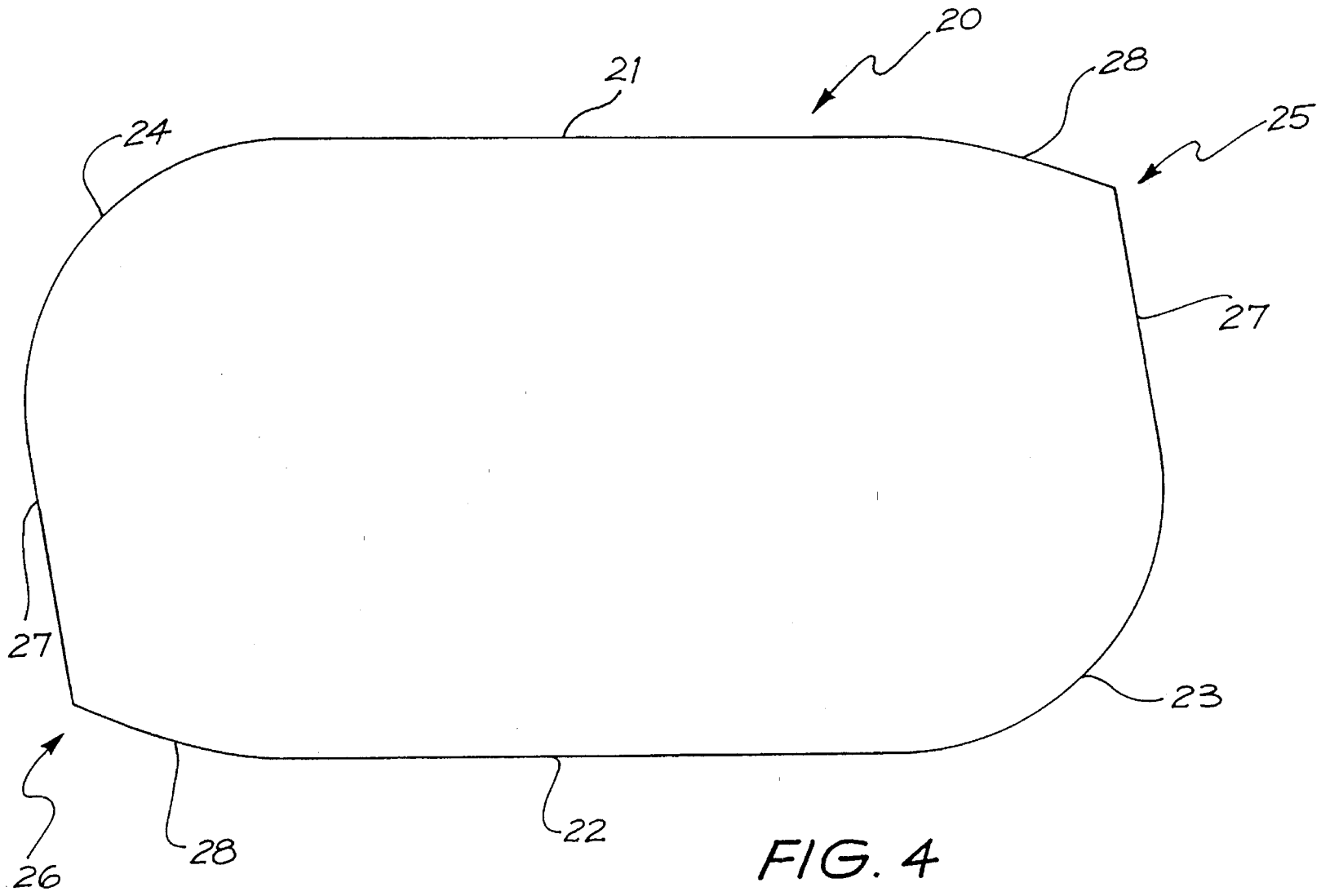
FIG. 4 shows an alternative panel shape of another embodiment.

FIG. 4 shows an alternative embodiment of a panel 20 which has parallel elongate sides 21 and 22, diagonally opposed curved corners 23 and 24, and diagonally opposed obtuse corners 25 and 26. However in this embodiment, the corners 25 and 26 are formed from an intersection of a straight edge 27, extending from the curved corners 23, 24, and a curved edge 28, extending from the sides 21, 22. In each case, the obtuse corners 25, 26 form a point which when formed in a ball structure ultimately forms the poles of the ball.

The preferred embodiment provides a panel shape that can be dyed in any desired color and combined with other panels of different color if desired to produce a ball with a multi-color effect. In each case, it is necessary to derive the panels from differently dyed substrate materials 13 which are separately cut from an identical template. The segmentation provides for economical cutting of leather, rubber, felt and other materials used in the manufacture of bails and also provides a means for isolating dye color and allocating a color per roll of sheet of specified material.

The "twist" which results in the completed ball segments as illustrated in FIG. 2, also adds to the strength of the resultant ball through the interconnection of the panels not lying in any one plane thereby permitting shearing and other forces that may be applied to the ball to be distributed to some extent throughout each panel and not necessarily along a join between panels.

One specific advance of manufacturing a ball of the preferred embodiment is that through the use of three panels, as opposed to the two panel tennis ball, a ball can be readily manufactured of three colors. For example, the manufacturer of BMW (registered trade mark) motor vehicles, may wish to manufacture a ball with the panel colors blue, white and black thereby representing the colors of that motor vehicle manufacturer. Also, a ball representing Germany may be manufactured with red, gold and black panels.

Alternatively, any three colors such as orange, yellow and lime green may be applied to the respective panels to obtain any desired multi-colored effect.

In a further embodiment, the panels can be colored in accordance with Australian Patent Application No. 56800/90 filed by the present Applicant to the extent that when a ball manufactured and colored with red, blue and green (for example) in accordance with the preferred embodiment, presents a pulsating light effect to an observer when it is spun. The pulsating light effect is derived from the perceived mixing by the human eye of the three colors in much the same way that a color television which incorporates only three colors can be varied to show different levels of intensity and hue.

In a further alternative embodiment, a ball manufactured with the preferred embodiment can have one or more panels impressed with a logo, trade mark, or other ornamentation such that the ball can be used for advertising or other promotional purposes for one or more products or organizations.

Where the panels are colored with bright fluorescent materials it is desirable to utilise a cold-glue process for joining the panels. This is because a traditional hot-glue process, as used for example with traditional tennis balls, can affect the brilliance of the color and may even change hue. The cold-glue process allows more pure substrates such as acrylics to be used thereby preventing deformation of the acrylic material which normally occur in the hot-glue process. Examples of cold glues include epoxy resins and silicones. With the cold-glue process, direct abutment between the panels can be obtained thereby avoiding the production of a broad (white) seam which occurs between the dumbbell panels of a traditional tennis ball.

The foregoing describes only a number of embodiments of the present invention, and modifications, obvious to those skilled in the art, can be made thereto without departing from the scope of the present invention.

Industrial Applicability

The present invention is applicable to the manufacture of balls and, in particular, to their economical and/or ease of manufacture through the reduction of wastage of substrate materials. Balls can be used for any number of purposes including promotional and advertising purposes.

I claim:

1. A ball comprising three substantially identically shaped panels joined together to form a substantially spherical surface, wherein each said panel, if laid flat prior to joining, is substantially rectangular in shape and comprises a pair of substantially straight and substantially parallel elongate edges, two diagonally opposed curved corner sections, and two diagonally opposed obtuse corner sections.

2. A ball as claimed in claim 1, wherein said panels are joined such that corresponding first obtuse corner sections of each said panel contact each other at a first point, and that corresponding second obtuse corner sections of each said panel contact each other at a second point diametrically opposed to said first point, said points representing poles of said ball.

3. A ball as claimed in claim 1, wherein said panels are differently colored in a predetermined hue sequence adapted to provide a pulsating visual effect when the ball is spun.

4. A ball as claimed in claim 1, wherein each said obtuse corner section comprises an intersection between two straight edges extending from adjacent curved corner section and elongate edges.

5. A ball as claimed in claim 1, wherein each said obtuse corner section comprises an intersection between a straight edge extending from an adjacent curved corner section and a curved edge extending from an adjacent elongate edge.

* * * * *